US007507308B2

(12) United States Patent
Dahlberg et al.

(10) Patent No.: US 7,507,308 B2
(45) Date of Patent: Mar. 24, 2009

(54) PROPELLANT AND A METHOD AND DEVICE FOR PRODUCING THE SAME

(75) Inventors: Johan Dahlberg, Orebro (SE); Lennart Selin, Kristinehamm (SE)

(73) Assignee: Eurenco Bofors AB, Karlskoga (SE)

( * ) Notice: Subject to any disclaimer, the term of this patent is extended or adjusted under 35 U.S.C. 154(b) by 288 days.

(21) Appl. No.: 10/473,804

(22) PCT Filed: Mar. 28, 2002

(86) PCT No.: PCT/SE02/00622

§ 371 (c)(1),
(2), (4) Date: Mar. 8, 2004

(87) PCT Pub. No.: WO02/083602

PCT Pub. Date: Oct. 24, 2002

(65) Prior Publication Data

US 2004/0216823 A1 Nov. 4, 2004

(30) Foreign Application Priority Data

Apr. 2, 2001 (SE) ..... 0101166

(51) Int. Cl.
*D03D 23/00* (2006.01)

(52) U.S. Cl. ..... 149/109.6

(58) Field of Classification Search ..... 149/109.6
See application file for complete search history.

(56) References Cited

U.S. PATENT DOCUMENTS 677,527 A * 7/1901 Maxim ..... 102/288
766,455 A * 8/1904 Maxim ..... 102/283
2,342,204 A 2/1944 Mackey (Continued)

FOREIGN PATENT DOCUMENTS

EP 1031547 8/2000

(Continued)

*Primary Examiner*—Aileen B Felton
(74) *Attorney, Agent, or Firm*—Connolly Bove Lodge & Hutz LLP

(57) ABSTRACT

The present invention relates to a method and a device for producing perforated propellant in the geometric form of block, stick, slab, cylindrical or tubular propellant (2) with high charge density and high progressivity. The propellant as claimed in the present invention is characterised by a large number of perforations, densely and evenly distributed over the entire propellant segments, made by perforation members (6) that are pressed down into the propellant. The perforations are thereby made in a plurality of steps with a predetermined step feed between each perforation operation. The device as claimed in the present invention also comprises a mobile pin die (5) away from but facing the feed path (1) for the propellant (2), and containing at least on one row of pins for perforation of the propellant whereby each such row of pins comprises the number of pins (6) required to cover the complete width of the propellant segment across its direction of advance. Between each perforation operation the propellant is step fed by a step feed device (15) a distance equivalent to the distance between two desired perforations multiplied by the number of rows of pins arranged across the direction of advance of the propellant. Additionally, in the propellant as claimed in the present invention the distance between two burning surfaces of the propellant shall be equal to double the desired burning length (2*b*).

14 Claims, 4 Drawing Sheets

U.S. PATENT DOCUMENTS

Figure 1:
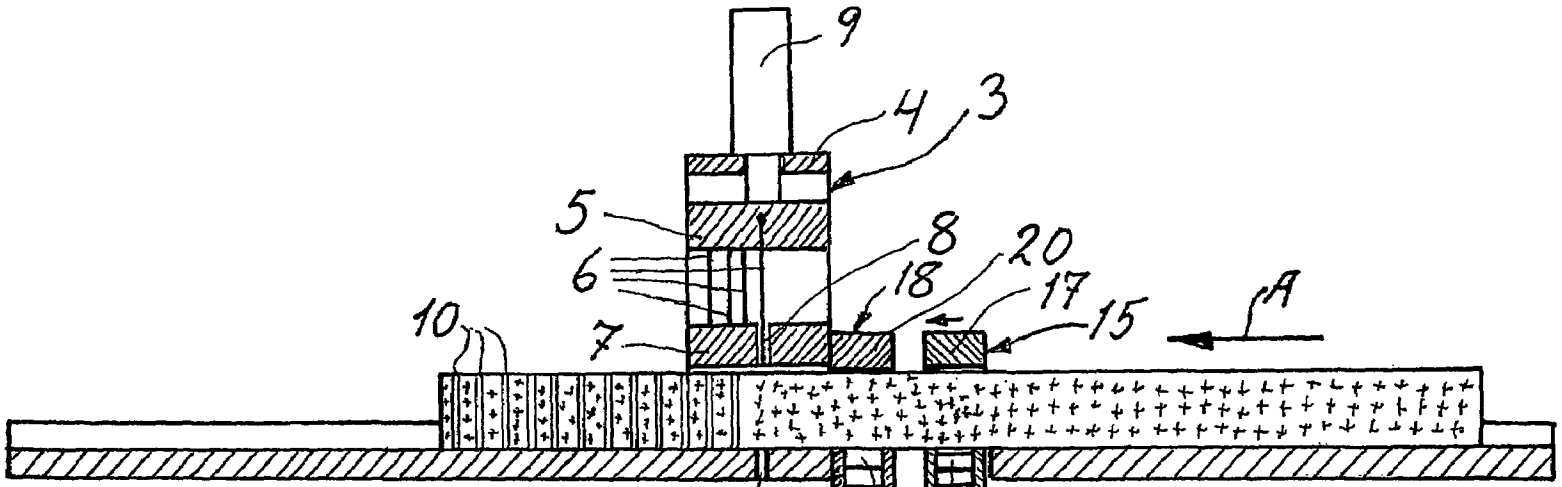

| | | | |
|---|---|---|---|
| 4,581,998 | A | 4/1986 | Horst, Jr. et al. |
| 5,129,304 | A | 7/1992 | Loomans et al. |
| 5,251,549 | A | 10/1993 | Boisseau et al. |
| 6,071,444 | A | 6/2000 | Worrell, Jr. et al. |

FOREIGN PATENT DOCUMENTS

| | | | |
|---|---|---|---|
| GB | 16861 | * | 0/1895 |

* cited by examiner

PROPELLANT AND A METHOD AND DEVICE FOR PRODUCING THE SAME

The present invention relates to a special type of perforated propellant with high burning progressivity, and with a geometric design that enables production of propellant charges with extremely high density. These characteristics make the propellant claimed in the present invention well suited for propellant charges for tube-launch weapons used for firing armour-piercing subcalibre projectiles, and for electrothermal-chemical canon systems. The present invention also includes a specific method for producing the actual propellant together with a dedicated device. Chemically the propellant can be of any type such as a conventional single-, double- or multi-base propellant, or one of the multi-base nitramine, dinitramide, dinitromethane, dinitroethylene or dinitropyridine propellants developed in recent years.

When igniting a progressive propellant the burning area, and thus also the gas emitted, gradually increase during virtually the entire burning process. Such a progressive propellant used in a tube-launch weapon produces a corresponding pressure curve, which enables optimum utilisation of the energy content of the propellant charge. For many years propellant charges for primarily larger calibre tube-launch weapons have utilised granular perforated propellant because such propellant has met the requirement for progressivity, and until now has also provided the desired charge density. Such granular propellant, which really is in the form of short cylinders with one, seven, nineteen or more evenly distributed through-holes forming combustion channels that increase the combustion surface of the propellant, have for practical reasons been put into propellant charges in no specific order, resulting in considerable empty space in the charges and relatively low charge density which, however, was previously acceptable. Nowadays, when all means are being used to try to extend the range of existing older artillery pieces as well as newly developed artillery, low charge density has begun to pose a significant problem as the feasibility of enlarging the charge space even in newly developed guns—and especially in older guns—is limited.

The present invention, as already mentioned, thus relates to a perforated propellant that more than meets the above stated general requirements for a progressive propellant, and which also—via its geometric configuration—enables production of compact charges of very high density.

The expression 'perforated' propellant herein denotes a propellant that is shaped in large or small blocks, sticks, thick slabs, cylinders, tubes or equivalent, and which perpendicular to one or more of their outer surfaces are provided with a large number of slender perforations, cavities or holes arranged at a predetermined distance from each other and extending right through or virtually through the segments of propellant. The mutual distance between these perforations—the separation distance—shall be so well adapted that the propellant when ignited starts to burn in all the perforations, attains the desired progressivity, and reaches burnout within the desired burning time. Because the propellant also burns inside the perforations, they become gradually enlarged, and it is this gradually growing burning area that gives the propellant its progressivity. The separation distance shall thus correspond to double the desired burning length since the propellant will burn from two adjacent perforations towards each other. It is also conceivable during perforation to leave a distance equivalent to double the desired burning length unperforated, either at the centre of the propellant stick or equivalent (i.e. after converging perforation from both directions), or along its opposite exterior face with perforation only from one side.

In practice it can be somewhat more complicated to perforate a propellant segment from two directions, but the length of perforation can then be restricted to half thereby minimising the risk of misalignment of the perforation holes, while the device used for the perforation operation can in principle consist of a mirror-image duplication of the device intended for single-side perforation.

In some cases it may be desirable to use a slightly smaller burning area for the propellant during the initial phase of combustion. This can be achieved by coating one or more faces of the propellant segment with a combustion retarding coating that must first be burnt off before the propellant stick can ignite from the said face or faces initially coated.

The fundamental principle for perforated propellant is nothing new, and one of those who obviously pondered a lot about the feasibility of perforating propellant was Hudson Maxim, who around the year 1900 took out a number of patents for various types of perforated propellant as well as methods for producing them. Even though Maxim appeared to have the basic principles for the feasibility of perforated propellant resolved, it is doubtful whether he converted his ideas into functioning products. At any rate, no indications of this being the case have been found.

One of Maxim's patents that is of special interest in the current context is U.S. Pat. No. 766,455, which describes a propellant in the form of blocks or thick slabs provided with a large number of perforations created by a number of "cell forming pins" that are pushed down into the propellant to the desired depth while the propellant preferably still contains some solvent. In that patent Maxim specified that the cells or perforations produced should not go deeper than that a quantity of propellant equivalent to the distance between the perforations should remain [unperforated] to the other side of the block or slab of propellant. The sole dimension in the text for the perforations in question is that the distance between the perforations could be ⅛ inch, which in most cases must be considered to be the maximum conceivable.

Fully pierced propellant is, however, illustrated in both Maxim's patents U.S. Pat. No. 677,527 and GB16,861, the latter dating from 1895. Neither of these patents appear to contain any dimensional data specifying appropriate dimensions for the perforations or the distance between them. However, the illustrations appended give the impression that Maxim considered that the perforations and the distance between them should be significantly larger dimensionally than what we nowadays have established gives optimum results.

Maxim also applied for patents for devices for production of progressive perforated propellant, and two representative such devices are described in SE 7728 from 1896. In the first of the devices described a thick slab of propellant is perforated in one simultaneous operation by the same number of pins as the number of perforations desired in the said slab. During this operation the slab of propellant is held enclosed between a base plate and a backing plate with side edges all round. The pins used for perforating are precisely guided by dedicated holed disks or dies, and are jointly operated by a hydraulic piston. Maxim also allowed for the fact that simultaneous perforation with such a large number of perforation pins as in this case means that space must be provided for the amount of propellant displaced. He has resolved this by enabling the upper backing plate to be displaced upwards somewhat at the same time as the pins are forced down into the slab of propellant. The device described is also designed with special indirect heating channels to give the nitrocellulose-based propellant the desired plasticity.

The second device described in SE 7728 for perforation of thick disk-shaped propellant is based on somewhat different principles: in this machine the propellant disk is gradually fed forwards by a feed roller so that the disk is located below a specially designed rotating pin roller or porcupine that has a number of internal successively projectable pins arranged by an eccentric shaft, which pins when the propellant disk passes between the feed roller and the porcupine make a row of perforations across the said disk. Each row of pins thus makes a row of perforations.

The first of Maxim's devices requires a very large number of pins, which makes the device expensive and complicated as each pin must be actively guided in its direction of motion. The design illustrated by Maxim may appear functional on paper, but in reality this is hardly the case as the complete pin device would be extremely difficult to fabricate, and would also be very delicate if it were to manufacture propellant slabs of useable size.

Maxim's second device with all its precision mechanics also seems to be more of an idea on paper than a really functional design and which, moreover, could never be fabricated to produce perforated propellant with sufficiently dense perforations as have been shown to be necessary to provide a propellant with the desired progressivity.

The present invention relates—as previously implied—to an improved perforated progressive single-, double- or multi-base propellant of every conceivable chemical composition including the multi-base nitramine, nitramide, dinitramide and nitroethylene propellants developed in recent years. The present invention also includes a special device for production of the said propellant.

A characteristic feature of the progressive propellant as claimed in the present invention is the internal and external geometry of the propellant which provides the progressivity and enables production of propellant charges with extremely high charge density. The basic external shape of the propellant as claimed in the present invention is not critical, while its internal geometry is characterised by an extremely high number of very densely arranged perforations originating from at least one of its external faces. The present invention is also independent of the chemical composition of the propellant, and independent of the external dimensions of the propellant segments. The objective for the propellant as claimed in the present invention is that it shall embody at least the same progressivity as a conventionally granulated perforated propellant such as that with 7, 19 or 37 perforations with the same chemical composition. Propellant as claimed in the present invention also embodies the benefit that its burning characteristics are independent of its external geometrical shape, thus enabling production of propellant charges with extremely high charge density. Using a perforated block, stick, slab, cylinder or tube of propellant of the type characteristic of the present invention as feedstock, a progressive propellant segment of any shape can be manufactured.

To achieve the above mentioned progressive burning characteristics equivalent to a granulated conventional perforated propellant with the same chemical composition, it is necessary to create perforations with diameters of 0.1 to approximately 1.0 mm arranged at a mutual distance of 0.5 to 6 mm from each other.

The present invention includes a specific device for producing the propellant in question. The basic principle of this device is to use a number of dedicated perforation pins in each operation stage to produce a limited number of rows of perforation openings in the propellant segment, and to perform an incremental advance between each operation. By limiting the number of perforation pins to one or at the most a few rows of perforation pins in the method as claimed in the present invention, it is possible to fabricate suitable 'pin dies' of sufficient precision. In the design of these pin dies each pin or perforation member passes through a dedicated guide opening in a pin alignment plate that also functions as a retainer bearing against the face of the propellant facing the pins when they are pressed down into the propellant and when they are withdrawn from the propellant.

The present invention also includes a specific design shape for the points of the pins, which are not ground to a conventional tapered point, but instead are ground to a cylindrical front section with an outer end that is abruptly cut off at right-angles relative to the direction of motion of the pin, and which outer end is preferably shaped with a markedly smaller front diameter than the remainder of the pin whereby this cylindrical outer end after a short distance reverts to the larger diameter of the main section of the pin via a sharp ring-shaped edge. Pins with points shaped in this very special manner have been shown to have considerably less tendency to pierce obliquely than pins with a tapered point. The propellant provides so much resistance, in fact, that there is always a risk that the pins will start to travel at an angle in the propellant if the piercing length of the pins in the propellant is sufficiently long. This risk of oblique travel in the propellant is subject to a pronounced increase if there is the slightest irregularity in the grinding of the point of the pin. (The problem with oblique travel applies even in the case of heated nitrocellulose and nitramine propellant with maximum solvent content.)

As previously mentioned the perforations in the propellant must be very dense to provide the desired burning characteristics. The distance between perforations must, in fact, be equal to double the desired burning length. For purely practical reasons it is as difficult to fabricate a pin die, i.e. an array of pins for simultaneous production of such densely located perforations, as it is to perform the perforations with such densely located pins. Moreover, for the finished perforated propellant to have the desired burning characteristics it is also necessary for as much as possible of the total quantity of propellant to burn progressively. At ignition the perforated propellant burns radially outwards from each perforation, which is why the perforations shall be located at a distance from each other equivalent to double the desired burning length. Thus, at the expiry of the desired burning time the combustion started radially from each perforation shall meet the combustions from adjacent perforations. As combustion thus progresses radially from two adjacent perforations it is unavoidable that small quantities of propellant will not be affected until after the end of the desired burning time. These non-active quantities of propellant must be kept as small as possible.

If perforation of the block, stick, slab, cylinder or tube of propellant in question is performed incrementally by a pin die in which the pins are located at a 90° degree angle relative to the direction of advance, and at a distance from each other equivalent to double the burning length, and each advance step between each perforation step is done in the same way with double the desired burning length multiplied by the number of rows of pins, the non-active quantity of propellant will then be relatively large.

If instead the perforations are made by a number of pins arranged along a line forming a 60° angle relative to the direction of advance of the propellant being perforated, and the pins are still located at double the desired burning length and advance between the perforation steps is equal to double the burning length multiplied by the number of rows of pins, the non-active quantity of propellant can be minimised.

The best solution however, which also constitutes a further development of the present invention, is to locate the pins in a straight line forming a 30° angle relative to the direction of advance of the propellant, and at a distance along this line equivalent to the desired perforation distance (i.e. double the burning length) multiplied by $\sqrt{3}$, while each advance step between two consecutive perforations is made equal to the desired perforation distance multiplied by the number of pin rows parallel to each other and at a 30° angle relative to the direction of advance. By exploiting this geometrical refinement it is possible to make the perforations denser compared with the distance between the pins employed, and as it is fabrication of the actual pin die that constitutes the largest practical problem in the production of perforated propellant with sufficiently dense perforations to meet the requirements stipulated for the practical application of the product, this is a particularly vital part of the actual invention.

A variant of this alternative is to locate the pins in an alternating manner along two straight lines arranged at double the burning length from each other and where the distance between the pins across the direction of advance is equal to double the burning length such that the pins are located in a zigzag manner, which makes it easier to fabricate the pin die since the pins are then at a somewhat greater distance from each other than otherwise would be the case. With an advance equal to double the burning length the subsequent perforation step supplements the row of holes from the previous perforation step, so that the end result is the same as if all the pins were located along a single straight line.

With the device as claimed in the present invention the desired incremental advance of the propellant between two perforation steps is achieved by a combined advance and return step feed device whereby a first holding device is actuated and when it has gripped the propellant the holding device is advanced the desired distance by the step feed device, after which a second holding device grips the propellant and holds it still while the pin die is actuated and the pins are pressed down into the propellant to the desired depth after which they are withdrawn from the propellant. Simultaneously the first holding device of the step feed device is made to release its grip on the propellant, after which the step feed device returns to initial position while the propellant is prevented from accompanying the return stroke by the second holding device.

This basic methodology for production of perforated propellant may seem elaborate as only one or possibly a few diagonal rows of perforations can be made in each work cycle, but it is also easy to fully automate and the machine required to perform the perforation operation can be fabricated using relatively elementary means.

As already mentioned the biggest difficulty in producing perforated propellant with sufficiently dense perforations is usually fabrication of the actual pin die. If—despite the precision engineering problems involved—pin dies incorporating a plurality of rows of pins can be fabricated, the feed advance step between each perforation step can be multiplied by an equivalent degree.

As already stated a number of times the present invention relates to a method for producing large segments of multi-perforated propellant, which can subsequently be used to produce propellant charges with very high charge density. As claimed in the present invention the propellant is perforated by a plurality of pins, combined in a single unit, that are driven or pressed down into the intended segment of propellant. The number of pins, however, can never be so great that the entire propellant segment can be fully perforated in a single operation. Consequently, the present invention is designed so that a limited number of perforations are made at a time by means of a limited number of pins arranged parallel with each other, and that the segment of propellant and the pins shall be displaced relative to each other between each perforation step such that in the next perforation step a previously unperforated section of the propellant segment is perforated. All the perforations shall thus be made by the same array of pins. The logically most obvious method—as described in the example below—is to drive or press the pins down into the propellant, but the opposite technique can, of course, be employed, i.e. to press the propellant segment against a fixed array of pins of similar design to that described above. In a corresponding way the pin die could be incrementally advanced across or along the propellant segment instead of the propellant segment being advanced under a pin die arrangement as in the device described below.

Figure 2:
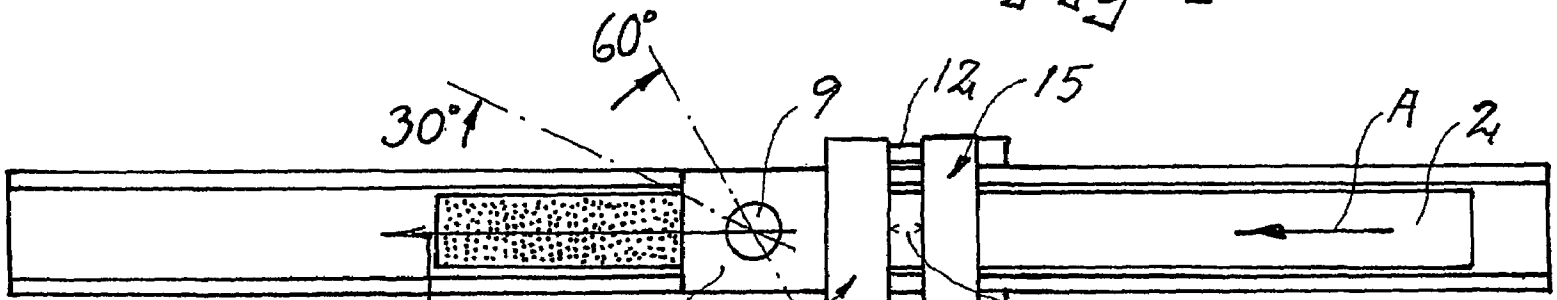
Figure 3:
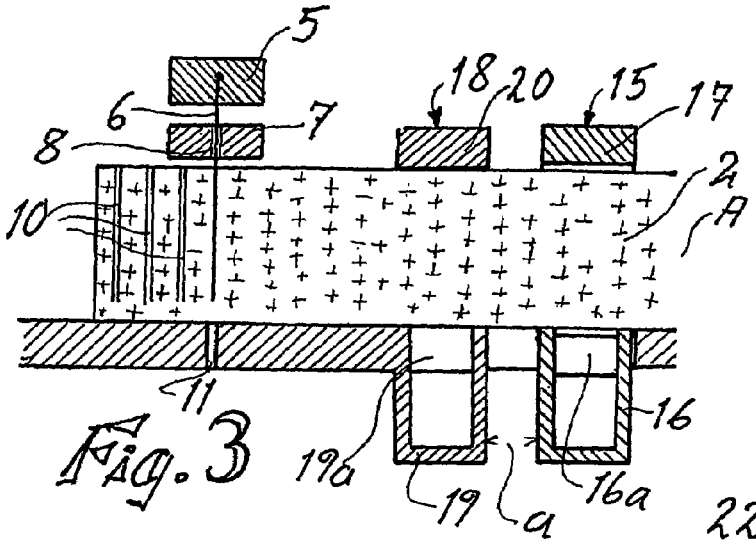
Figure 5:
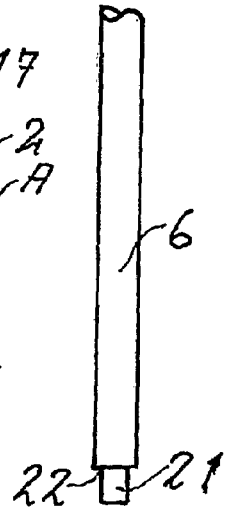
Figure 9:
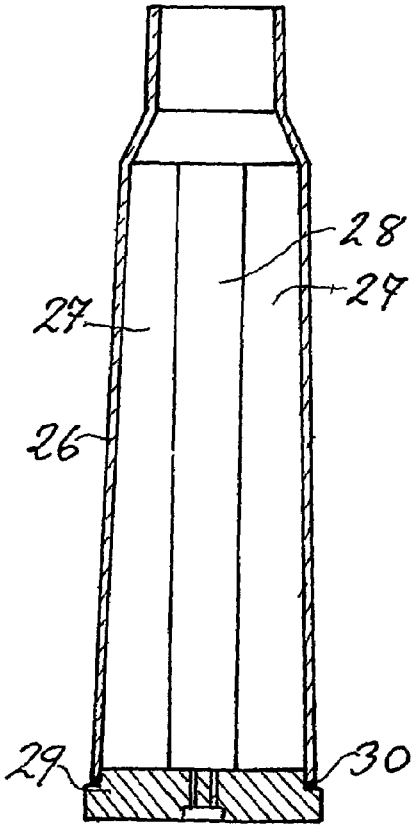
Figure 4:
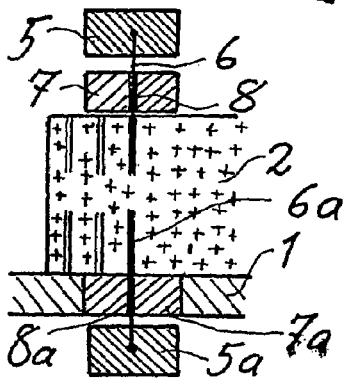
Figure 10:
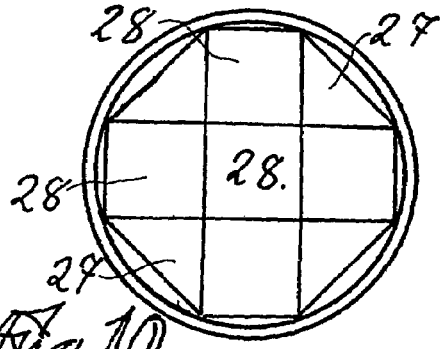
Figure 6:
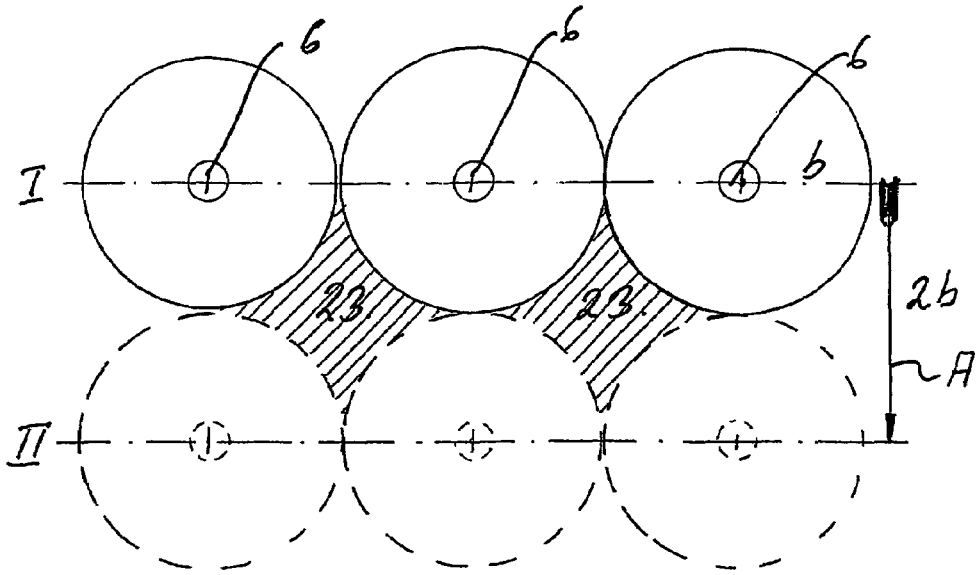
Figure 7:
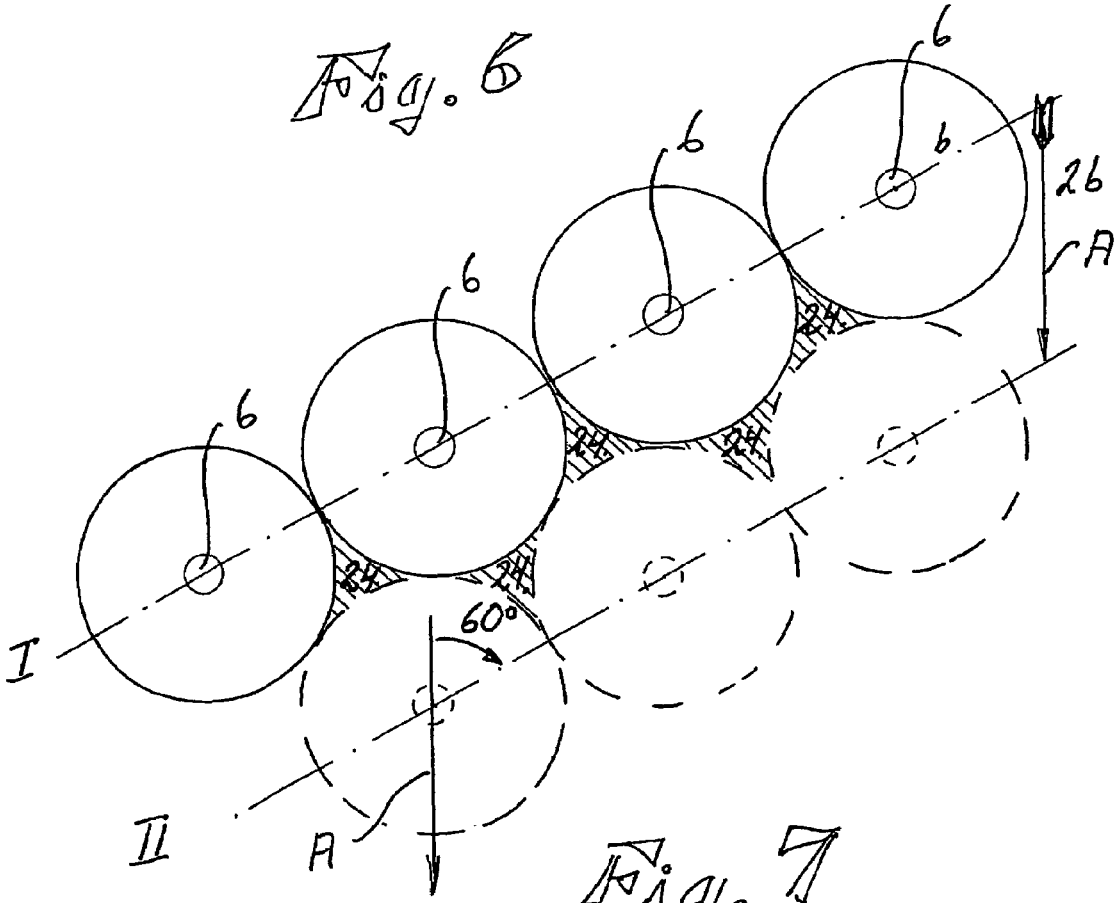
Figure 8:
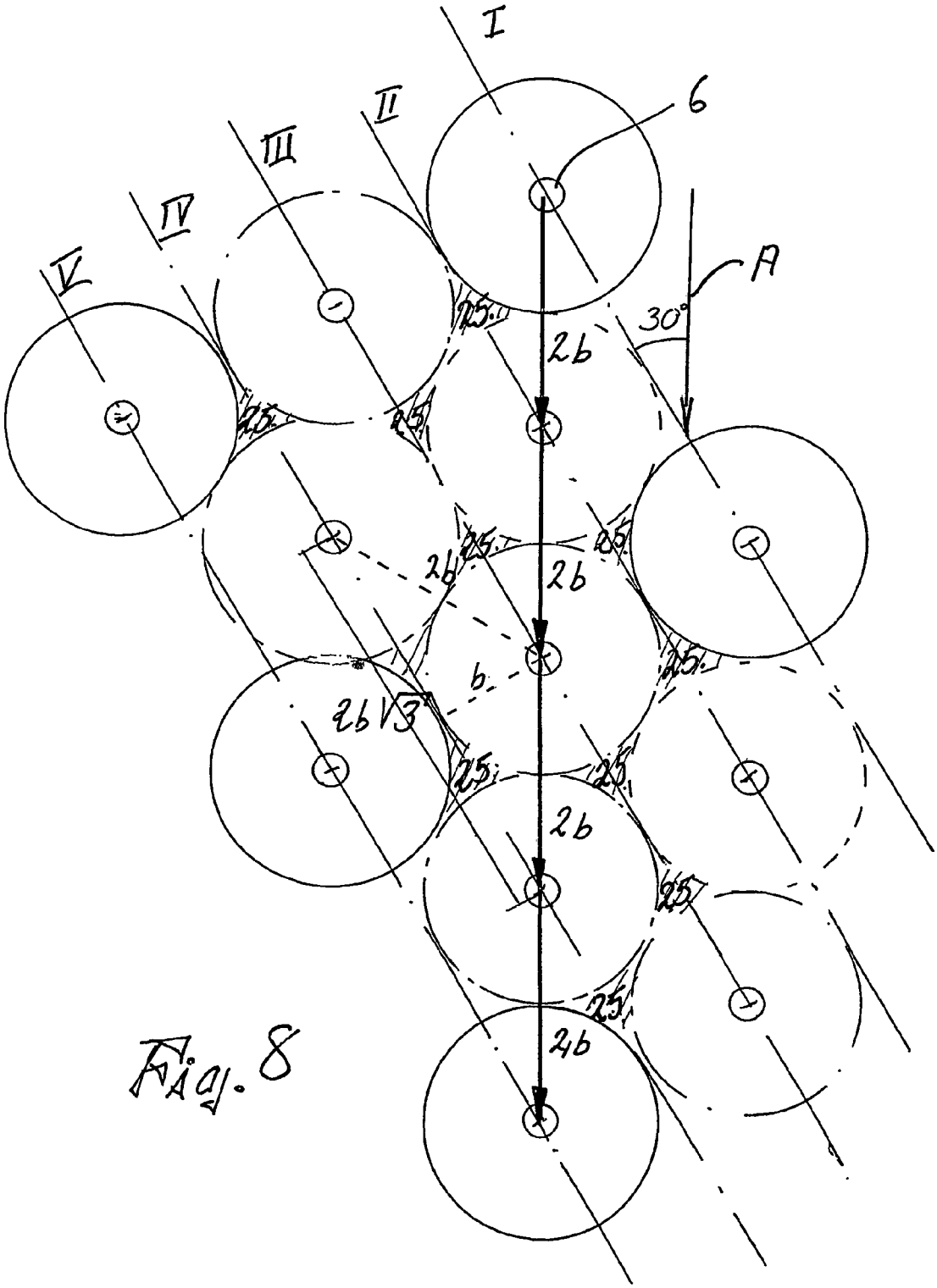

The distinctive features of the present invention are defined in the subsequent patent claims, and the invention shall now be described only in slightly more detail with reference to the appended figures, which relate to a representative device for the performance of the procedure as claimed in the present invention.

Wherein FIG. 1 depicts a side elevational cross-sectional view through a representative device, FIG. 2 depicts the device illustrated in FIG. 1 when viewed vertically from above, FIG. 3 represents an enlarged cross-sectional view through parts of the device depicted in FIG. 1, FIG. 4 depicts a double-sided perforation variant, FIG. 5 represents a perforation pin on an enlarged scale, FIG. 6 depicts lines of perforations by pins at right-angles to the direction of advance, FIG. 7 depicts lines of perforations by pins at an angle of 60° to the direction of advance, FIG. 8 depicts lines of perforations by pins at an angle of 30° to the direction of advance, FIG. 9 represents a cartridge case filled with perforated propellant, and FIG. 10 represents an enlarged scale cross-section through the propellant charge depicted in FIG. 9.

The device depicted in FIGS. 1-3 incorporates a feed table 1 on which a stick of propellant 2 is positioned. The propellant stick 2 can be incrementally advanced in direction A under a perforation device 3. This device comprises a support 4 in which a pin holder 5 is mounted that is displaceable towards and from the propellant stick 2, a number of perforation pins 6 mounted in and extending in the direction of motion of the pin holder 5, an alignment plate 7 with an alignment hole 8 for each of the pins 6, and an operating cylinder 9 for displacement of the pin holder 5 and pins 6 from an initial idle position depicted in FIG. 1 to a second perforation position in which the pins 6 are fully depressed into the propellant 2 and from which position they are subsequently retracted leaving finished perforation openings 10 in the propellant 2. The feed table 1 also comprises an opening 11 for each of the pins 6 immediately under the position where the pins penetrate through the propellant stick 2. This is to ensure that the pins are not damaged when they break through the propellant. As depicted in FIG. 3 the perforation can be discontinued at a distance of double the desired burning length from the lower face of the propellant stick. It is entirely satisfactory to discontinue perforation at this distance from the lower face of the propellant stick since the propellant will ignite both at the base of the perforation as well as from its own outer surface.

To advance the propellant between each perforation step there is a feed device 15 displaceable in the desired direction of advance and located on two guides 12 and 13. The operating cylinders for displacement of feed device 15 from the idle position depicted in the figures to advance position B and back can be located inside the guides 12 and 13. The advance step to be performed by feed device 15 between each perforation step is designated 'a' on FIGS. 2 and 3.

To enable propellant stick 2 to accompany the advance step when the feed device moves forwards the said device is equipped with a first gripper device in the form of an operating cylinder 16 whose piston 16*a*, when actuated immediately before the feed device starts to move forwards in the direction of advance, lifts up the propellant stick 2 against a retainer 17 which is an integral part of the said feed device. To prevent any displacement of the positioning of the propellant stick during perforation by pins 6 and when the feed device 15 returns to initial position there is a second holding device 18 comprising an operating cylinder 19, attached to the feed path 2, as well as a displaceable piston 19*a* and a fixed retainer 20. This piston system is activated as soon as the feed advance step is completed, and is kept active until the immediately following perforation step is completed and the feed device is returned to initial position. In addition, piston 19*a* lifts the propellant stick and presses it against the fixed retainer 20.

FIG. 3 depicts parts of the same device shown in FIGS. 1 and 2 but on a larger scale. Like numerals are therefore used to designate like parts. The only difference is that in FIG. 3 the perforation depth of the pins 6 has been corrected to leave a distance equivalent to double the desired burning length unperforated. The pin 6 depicted in the figure is shown at its lowermost position, holding system 18 in its locked position, and feed device 15 in its zero position.

FIG. 4 depicts the changes that must be made to the device as depicted in FIGS. 1-3 to enable double-sided perforation to be performed. The main difference is that it has been possible to recess the alignment plate for the pins 6 into the feed path, where it is designated 7*a*. The pins that thereby produce perforations from below are designated 6*a* and the pin holder is designated 5*a*.

FIG. 5 depicts the design of the outermost point of the pins 6 that has been shown to give the least tendency to adopt an oblique angle when perforating. Pin 6 is thus designed with a short cylindrical outer section 21 with a square cut-off front termination. This cylindrical outer section adjoins the remaining cylindrical face via a ring-shaped edge 22.

FIGS. 6-8 depict the results with different pin locations for perforation. The rows of perforations are designated I, II, III, IV, V in the order in which they are produced. The direction of advance of the propellant stick is designated A as previously mentioned. The desired burning length is designated b. The pins, as well as the perforations produced in a previous perforation step, have been assigned the previously used general designation 6.

As shown in the alternative illustrated in FIG. 6 the pins are located at a distance 2b from each other, and the feed advance between the perforation steps is also 2b, i.e. twice the burning length, while the pins are located in a row at right-angles to the direction of advance. Only three pins 6 and feed advance rows I and II are illustrated on the figure as this is sufficient. As shown on the figure the non-active volumes of propellant, designated 23, are relatively large in this variant.

As illustrated in FIG. 7 a denser pattern of perforation is obtained, and thereby a considerable reduction in the non-active volume of propellant 24, if the row of pins is arranged at an angle of 60° relative to the direction of advance.

FIG. 8 finally illustrates that with the row of pins arranged at an angle of 30° relative to the direction of advance a denser pattern of perforation, relative to the distance between pins, is obtained. The feed advance in this variant is also 2b (i.e. twice the burning length) or, with pin dies containing a plurality of rows of pins, multiplied by the number of rows of pins. If this refinement is employed the perforations will be at a distance of 2b from each other despite the fact that the distance between the pins has been extended from 2b to $2b\times\sqrt{3}$, which considerably simplifies fabrication of the pin die even if it also means that it must comprise more pins to cover the width of the propellant stick in question. As illustrated in the figure the volume of non-active propellant, here designated 25, even in this case is also small.

FIGS. 9 and 10 depict a filled cartridge case 26 containing four propellant sticks of type 27 and five of type 28 produced as claimed in the present invention. On the figures propellant sticks 27 and 28 are illustrated with flat sides, but they can also be jointly shaped to form a round propellant charge that completely fills the cartridge case 26. The cartridge case illustrated is here assumed to be of a special type with a base section 29 that is installed after the case is filled with propellant. The joint between the main and base sections of the cartridge case, which joint can be fabricated in any elective manner, is designated 30.

The invention claimed is:

1. A method for producing a perforated propellant segment, comprising:

providing a propellant segment;

incrementally advancing the propellant segment along a feed table in a direction of advance; and perforating the propellant segment with a plurality of perforation members as the propellant segment is advanced incrementally, wherein the perforations are produced at a mutual distance from each other that is substantially equivalent to double a desired burning length for a charge for which the propellant segment is intended, and wherein the plurality of perforation members are arranged along at least one line extending across the feed table at an angle of 20-70 degrees with respect to the direction of advance of the propellant segment on the feed table.

2. The method of claim 1, wherein perforating produces a plurality of perforations in the form of through-holes or dead-end holes that are parallel with each other and that are evenly distributed over the entire volume of the propellant segment; and the perforated propellant segment has a high progressivity.

3. The method of claim 1, wherein perforation is effected by driving a pin die comprising a plurality of pins down into the propellant segment to a desired depth, wherein the method further comprises:

retracting the pins to an initial position.

4. The method of claim 3, wherein the pin die comprises at least one row of the plurality of pins that are equal in number to a desired plurality of perforations along a line across the propellant segment.

5. The method of claim 4, wherein the propellant segment is incrementally advanced between each perforation operation by a distance equal to double the desired burning length multiplied by the number of rows of pins comprised in the pin die.

6. The method of claim 5, wherein the distance between the pins along the line is adjusted such that after a number of consecutive perforation operations the propellant segment is completely covered by perforations arranged at a mutual distance of double the burning length from each other.

7. The method of claim 6, wherein the propellant segment is in the form of a block, stick, slab, cylinder or tube.

8. The method of claim 3, wherein the pins are arranged along said at least one line extending across the direction of advance, wherein the angle is at 20-40 degrees with respect to the direction of advance.

9. The method of claim 8, wherein the angle is at 25-35 degrees with respect to the direction of advance.

10. The method of claim 3, wherein the pins are arranged along at least one line, wherein the line is oriented at 50-70 degrees to the direction of advance.

11. The method of claim 10, wherein the line is oriented at 55-65 degrees to the direction of advance.

12. The method of claim 1, wherein the position of the propellant segment is fixed during perforation and the propellant segment is incrementally advanced between each perforation.

13. The method of claim 1, wherein incrementally advancing the propellant segment comprises:

advancing the propellant segment in a forward and reciprocal pattern using a step feed device, wherein a holding device grips the propellant segment and releases the propellant segment before a return stroke.

14. The method of claim 13, wherein the position of the propellant segment is fixed during the return stroke.

* * * * *